US011136184B2

(12) United States Patent
Cesur et al.

(10) Patent No.: US 11,136,184 B2
(45) Date of Patent: Oct. 5, 2021

(54) METHOD OF MANUFACTURING AN FIBC, FIBC

(71) Applicant: BIGBAGSAN CUVAL DIKIM VE SANAYI VE TIC A.S., Istanbul (TR)

(72) Inventors: Cihan Cesur, Istanbul (TR); Fatih Nasirli, Istanbul (TR); Sevket Yildiz, Istanbul (TR)

(73) Assignee: BIGBAGSAN CUVAL DIKIM VE SANAY VE TIC A.S., Istanbul (TR)

( * ) Notice: Subject to any disclaimer, the term of this patent is extended or adjusted under 35 U.S.C. 154(b) by 179 days.

(21) Appl. No.: 16/347,057

(22) PCT Filed: Nov. 2, 2016

(86) PCT No.: PCT/TR2016/050418

§ 371 (c)(1),
(2) Date: May 2, 2019

(87) PCT Pub. No.: WO2018/084815

PCT Pub. Date: May 11, 2018

(65) Prior Publication Data

US 2020/0071068 A1 Mar. 5, 2020

(51) Int. Cl.

| | |
|---|---|
| ***B65D 88/16*** | (2006.01) |
| *B31B 150/00* | (2017.01) |
| *B31B 160/20* | (2017.01) |

(52) U.S. Cl.

CPC .... *B65D 88/1681* (2013.01); *B31B 2150/002* (2017.08); *B31B 2160/20* (2017.08); *B31B 2241/00* (2013.01)

(58) Field of Classification Search

CPC ..... B65D 88/1681; B65D 88/16; B65D 88/1612; B31B 2150/002; B31B 2160/20; B31B 2241/00

See application file for complete search history.

(56) References Cited

U.S. PATENT DOCUMENTS

| | | | | |
|---|---|---|---|---|
| 2,341,547 A * | 2/1944 | Heineman | ..... | B65D 88/76 220/565 |
| 6,010,245 A * | 1/2000 | Ross | ..... | B65D 88/1631 383/105 |
| 8,678,652 B1 * | 3/2014 | Nattrass | ..... | B65B 1/04 383/119 |

(Continued)

FOREIGN PATENT DOCUMENTS

| | | | | |
|---|---|---|---|---|
| EP | 0665175 A1 * | 8/1995 | ..... | B65D 88/1687 |
| EP | 2001769 A1 | 12/2008 | | |

(Continued)

OTHER PUBLICATIONS

International search report and written opinion, dated Jul. 21, 2017, of International Application No. PCT/TR2016/050418; 10 pgs.

*Primary Examiner* — Nathaniel C Chukwurah
*Assistant Examiner* — Lucas E. A. Palmer
(74) *Attorney, Agent, or Firm* — Kilpatrick Townsend & Stockion LLP

(57) ABSTRACT

A novel method for manufacturing a cubicle flexible intermediate bulk container is disclosed. At least two opposing sidewalls of the cubicle FIBC has a lower portion and an upper portion, both of which are formed of a combination of sheet material cut in rectangular and trapezoidal geometries.

4 Claims, 5 Drawing Sheets

(56) References Cited

U.S. PATENT DOCUMENTS

Figure 1:
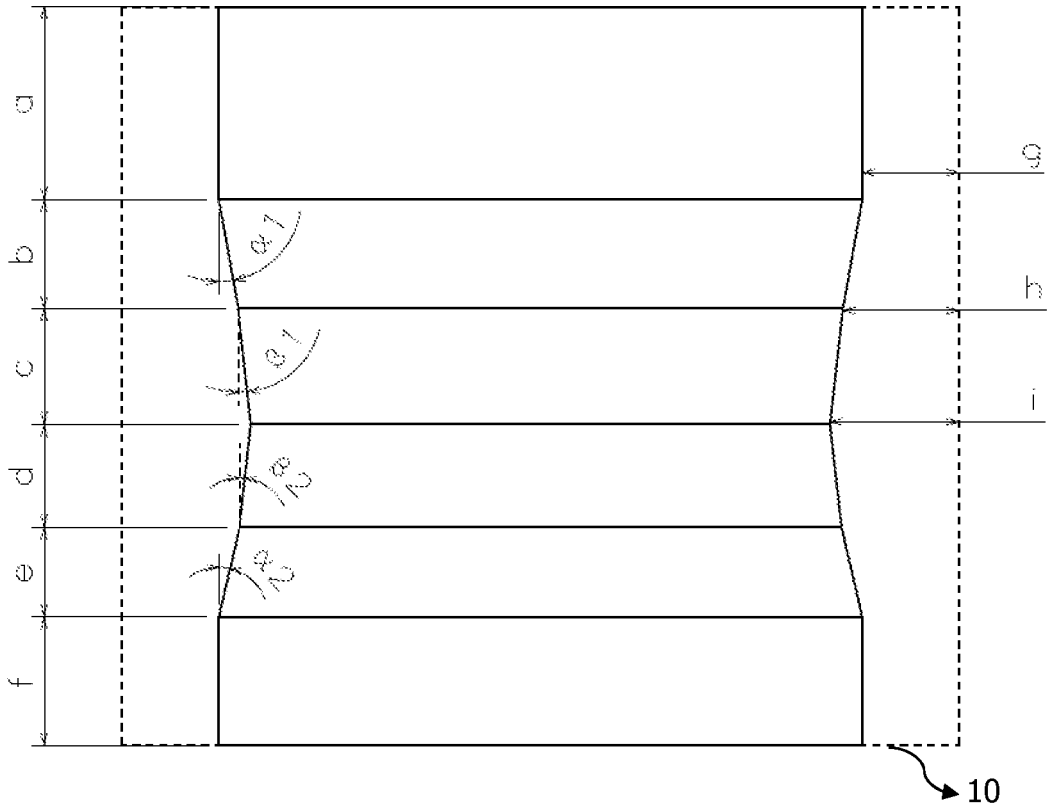

| | | | | |
|---|---|---|---|---|
| 2006/0023973 | A1* | 2/2006 | Plunkett | B65D 88/1618 383/22 |
| 2008/0283524 | A1* | 11/2008 | Kosich | B65D 88/1612 220/9.1 |
| 2009/0317024 | A1* | 12/2009 | Jeong | B65D 88/1612 383/119 |
| 2017/0008696 | A1* | 1/2017 | Porner | B65D 88/1656 |
| 2017/0203916 | A1* | 7/2017 | Diao | B65D 33/105 |

FOREIGN PATENT DOCUMENTS

| | | | | |
|---|---|---|---|---|
| FR | 2135897 | A5 | 12/1972 | |
| WO | 2006014146 | A2 | 2/2006 | |
| WO | WO-2006014146 | A2 * | 2/2006 | B65D 88/1631 |
| WO | WO-2013135520 | A1 * | 9/2013 | B65D 85/70 |
| WO | 2015110567 | A1 | 7/2015 | |

* cited by examiner

METHOD OF MANUFACTURING AN FIBC, FIBC

RELATED APPLICATIONS

This application is a U.S. National Phase of International Application No. PCT/TR2016/050418, filed Nov. 2, 2016, the entire disclosure of which is incorporated by reference herein.

TECHNICAL FIELD OF THE INVENTION

The present invention relates to a new method of manufacturing an FIBC (Flexible Intermediate Bulk Container). The FIBC is used to transport bulk material, typically granular or particulate material. During transportation, a multiplicity of the FIBCs is located in a standard confined container whose dimensions are fixed worldwide by the transportation industry. The FIBC concerned in the present application have a cubical geometry with generally rectangular sidewalls and a lower wall stitched to the lower edges of four sidewalls of the FIBC. The FIBC may have liner for transporting fine particulate or semi-viscous flowable materials.

BACKGROUND OF THE INVENTION

The use of large bags of fabric, commonly called flexible, intermediate bulk containers (FIBCs) or simply bulk bags, has become commonplace for transporting bulk quantities of powdered or granular materials. Bulk bags can be lifted and moved by forklift trucks and other material handling equipment having hooks. The cloth for the bulk bags is usually woven of strong, tape-like plastic fibers, usually made of polypropylene. Flexible intermediate bulk containers have come into widespread use for receiving, storing, transporting, and discharging flowable materials of all types, including for liquids, but mostly for granular materials.

Transportation industry uses containers whose dimensions are standardized worldwide. Once FIBCs are filled with the material to be transported, they have to be loaded in standard size containers for shipment. Usually, FIBCs are stacked on top each other and put in a row of two FIBCs located side by side in order to fully utilize the volume in a standard size container. In cases where the sidewalls of an FIBC makes bulges, two FIBC may not be located side by side due to the size constraint of the standard size confined shipment container. Therefore, bulges which occur due to pressure inside an FIBC in the filled state are unwanted and may result in transportation of less amount of material. If bulge occurs in one or more of the sidewalls of the FIBC, it may prevent loading of a neighboring FIBC due to limited space in a standard size confined shipment container.

EP2001769 A1 discloses a container bag for containing particulate materials, which is prevented from being barreled and retained in a stable erect state when contents fill the container bag, whereby the container bag can maximize the loadage of the particulate materials within a limited space with stability. The container bag includes lateral walls, the particulate materials filling an inner space defined by the lateral walls, a bottom wall formed generally in a quadrangle shape and connected to the bottom ends of the lateral walls, a cover connected to the top ends of the lateral walls, and hoops connected to the top ends of the lateral walls, the cover, the lateral walls and the bottom wall being formed from a flexible material, wherein each side of the quadrangle-shaped bottom wall is recessed at the central area thereof. While the recess in the central area of the bottom wall is intended to eliminate bulging of the sidewalls of the FIBC, it is known in the industry the FIBC obtained as such still exhibits bulges when filled with the material to be transported. The bulges may result in the drawback of the forming empty spaces in a standard size container. The FIBC industry manufactures FIBCs having only a small amount of tolerance for bulges that form inevitably due to the large pressure formed inside the FIBC in the filled state. Nevertheless, if the FIBC makes bulges more than the expected tolerances, this would result in shipment of less number of FIBCs in a standard size container.

SUMMARY OF THE INVENTION

The present invention discloses a method of manufacturing a flexible intermediate bulk container, comprising the steps of;

a) Cutting flexible sheet material in the form of an rectangular envelope for forming a sidewall of the FIBC
b) Marking the envelope such that the envelope has an upper portion and a lower portion
c) Folding the right and left side edges of the upper portion such that the upper portion has
   - a first upper portion in the form of a rectangle having a predetermined height,
   - a second upper portion in the form of an isosceles trapezoid whose upper base is wider than its lower base and whose side edge is inclined with an angle of $\alpha 1$ with respect to the vertical axis,
   - a third upper portion in the form of an isosceles trapezoid whose upper base is wider than its lower base and whose side edge is inclined with an angle of $\beta 1$ with respect to the vertical axis,
d) Folding the right and left side edges of the lower portion such that lower portion has
   - a first lower portion in the form of a rectangle having a predetermined height,
   - a second lower portion in the form of an isosceles trapezoid whose lower base is wider than its upper base and whose side edge is inclined with an angle of $\alpha 2$ with respect to the vertical axis
   - a third lower portion is in the form of an isosceles trapezoid whose lower base is wider than its upper base and whose side edge is inclined with an angle of $\beta 2$ with respect to the vertical axis,
e) Tacking the folded side edges of the lower portion and the upper portion,
f) Stitching side edges of four sidewalls to each other such that all sidewalls of the FIBC are formed,
g) Stitching a bottom wall to the lower edges of the four sidewalls,
h) Stitching a plurality of handles to the sidewalls of the FIBC.

The present invention also discloses an FIBC having at least two opposing side walls manufactured by the method described above.

OBJECTS OF THE PRESENT INVENTION

Primary object of the present invention is to provide a flexible intermediate bulk container in which the mount of bulges on the sidewalls of an FIBC in the filled state are reduced.

A further object of the invention is to provide a method for manufacturing and FIBC in a simple and cheap manner, where said FIBC is resistant to bulges on its sidewalls.

BRIEF DESCRIPTIONS OF THE DRAWINGS

The figures whose brief explanations are herewith provided are solely intended for providing a better understanding of the present invention and are as such not intended to define the scope of protection or the context in which said scope is interpreted in the absence of the description.

Figure 2:
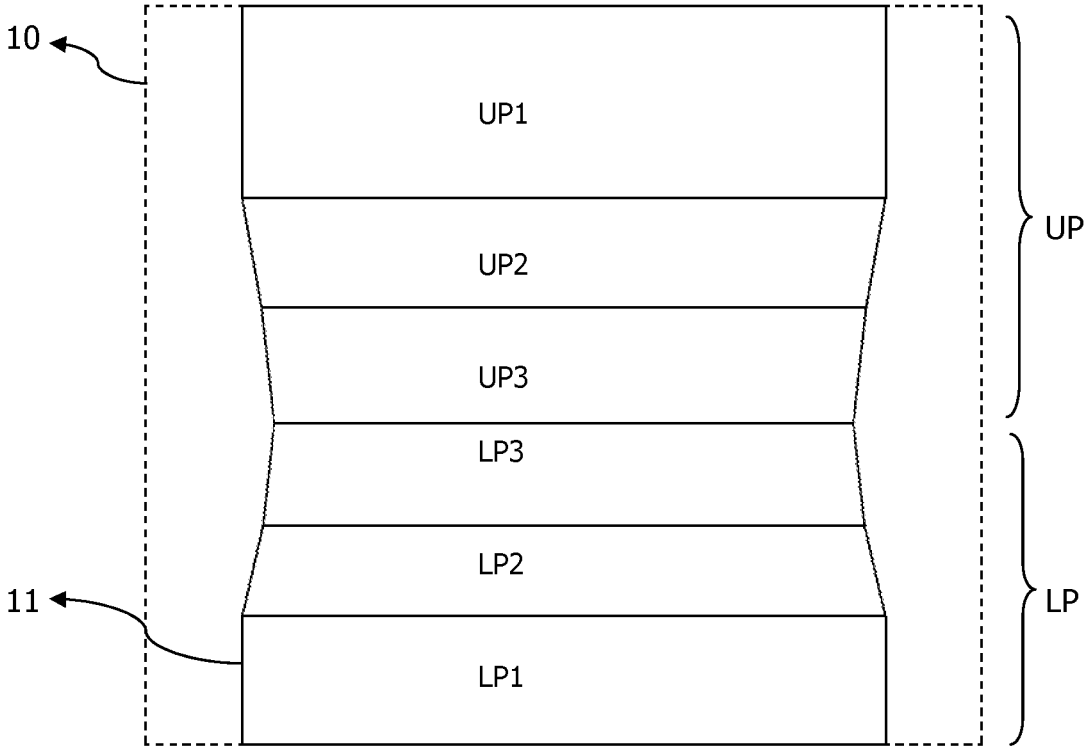
Figure 3A:
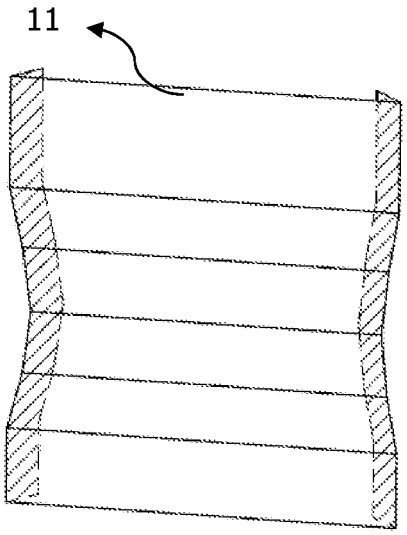
Figure 3B:
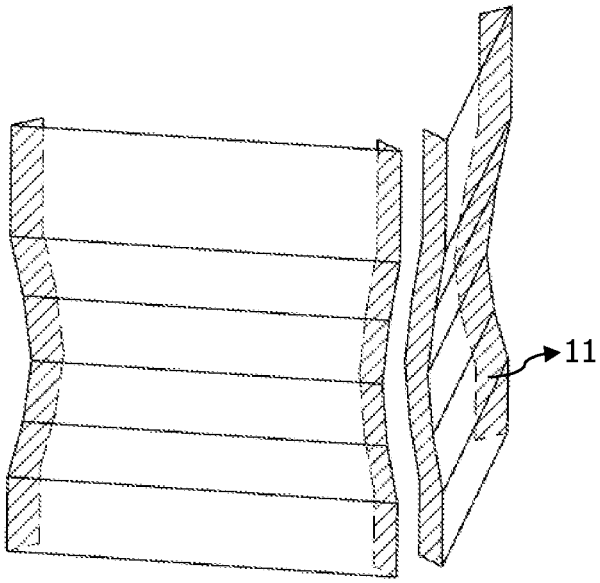
Figure 3C:
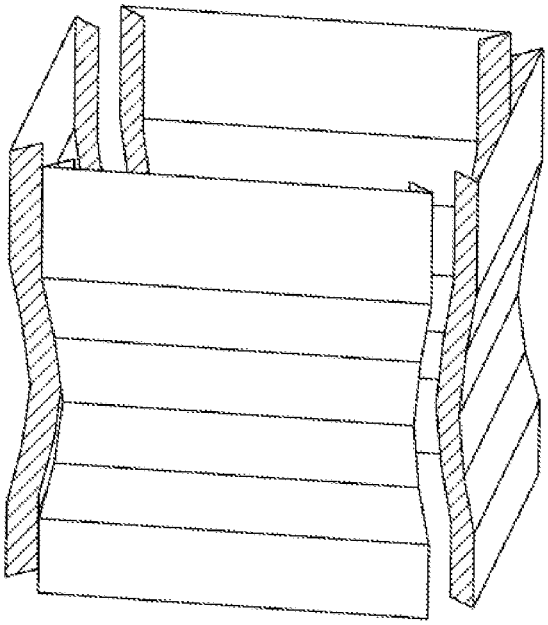
Figure 4A:
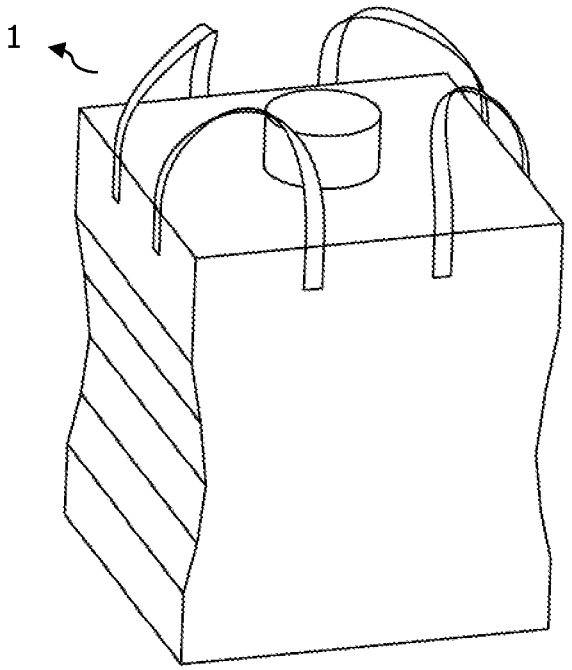
Figure 4B:
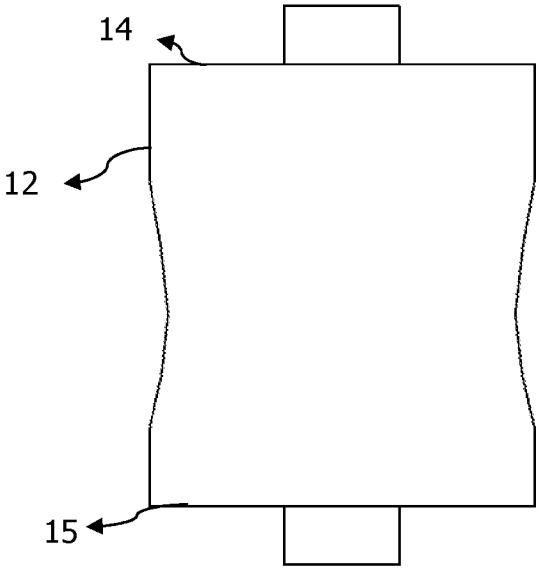
Figure 4C:
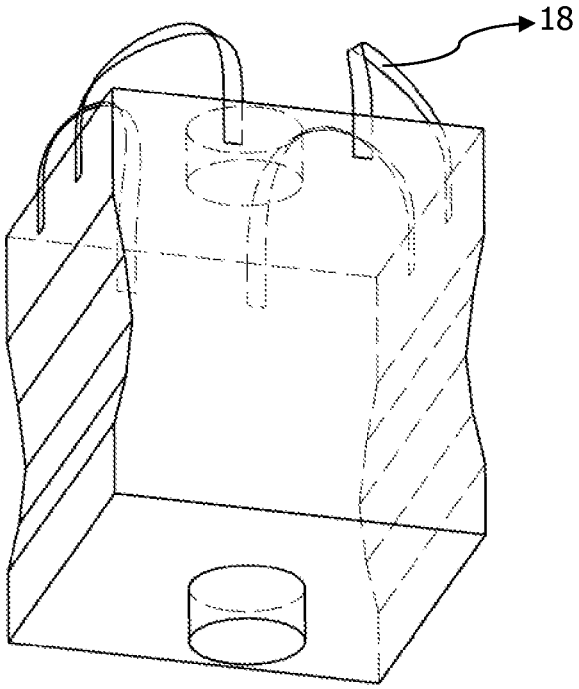
Figure 4D:
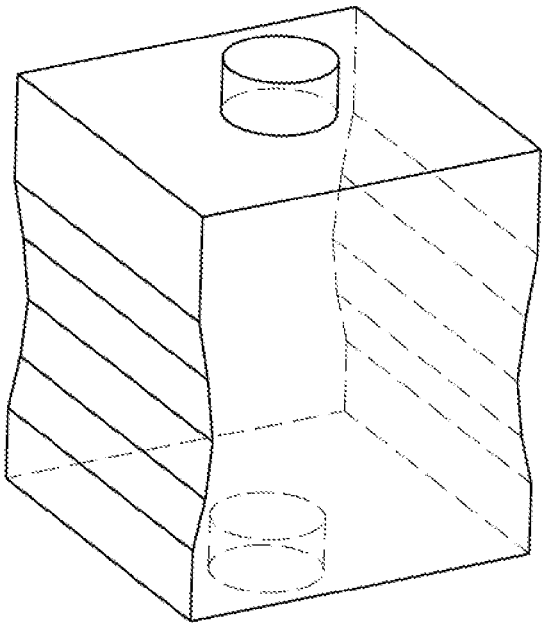
Figure 5A:
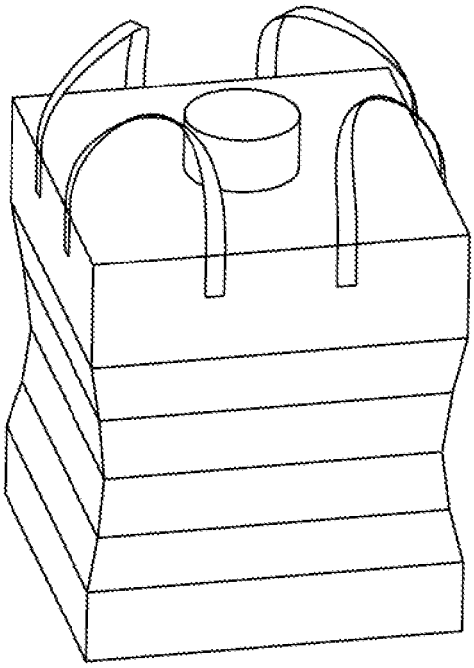
Figure 5B:
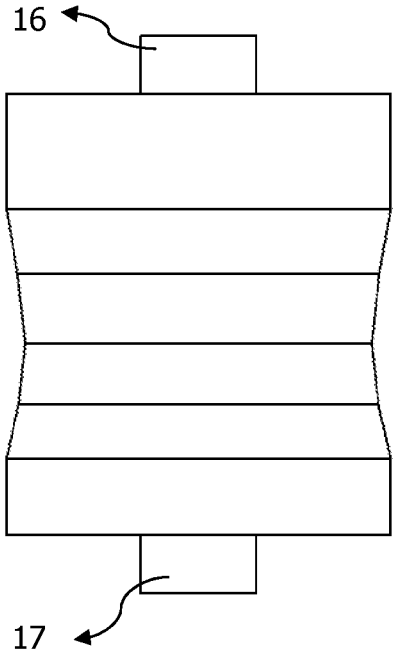
Figure 5C:
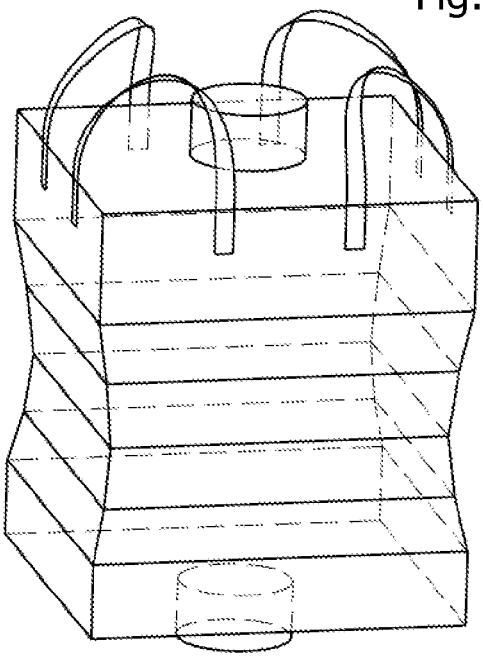
Figure 5D:
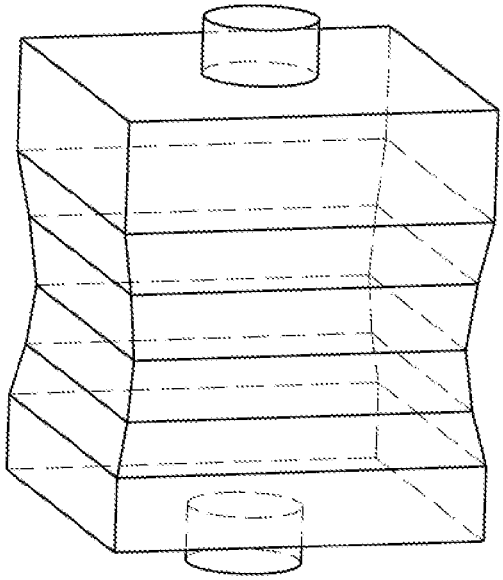
Figure 6:
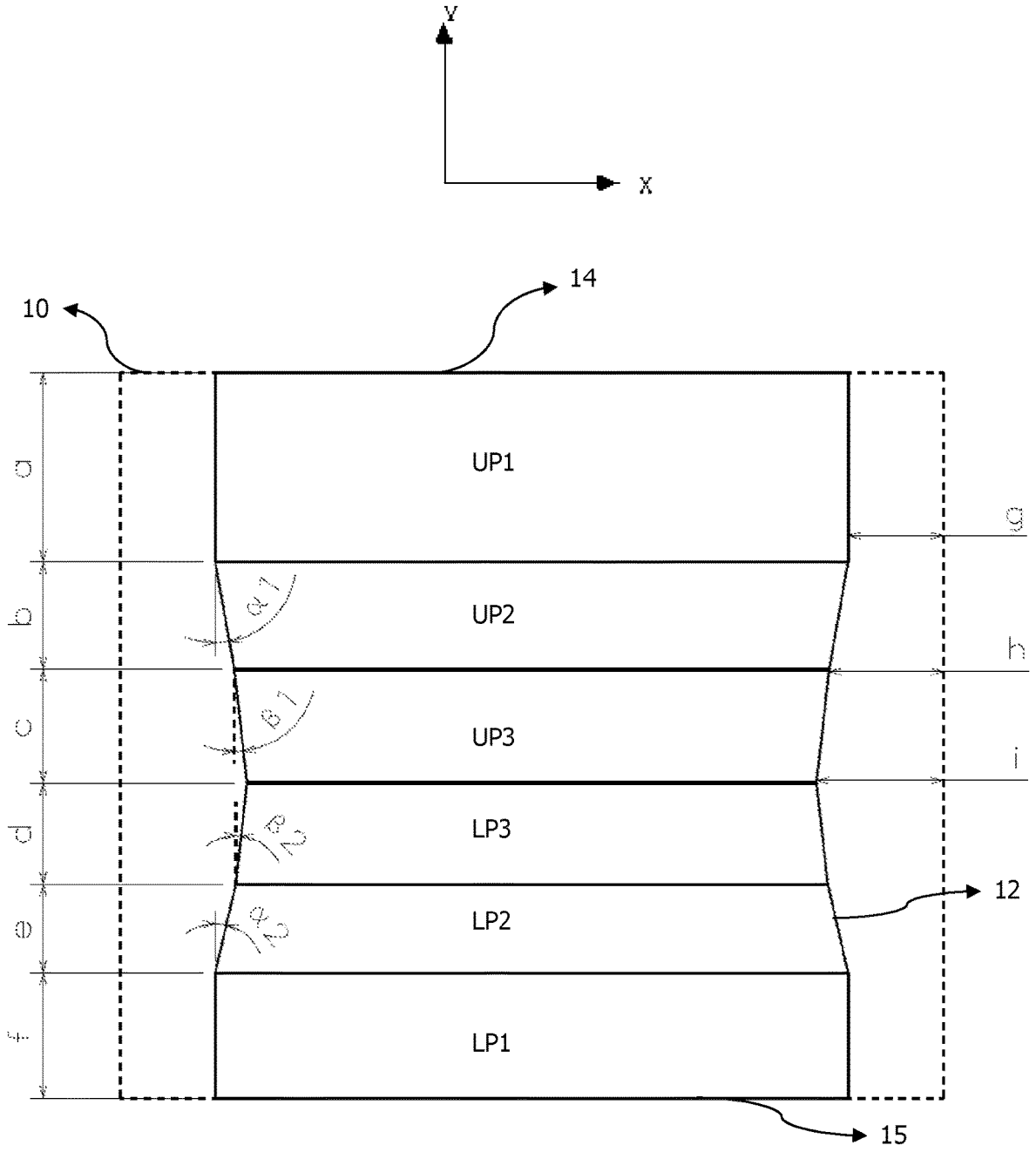

FIG. 1 shows a 2-dimensional view of the sidewall of an FIBC according to the present invention, FIG. 2 shows a 2-dimensional view of an envelope used for forming the sidewall of an FIBC according to the present invention, FIGS. 3*a*, 3*b* and 3*c* show a plurality of sidewalls of an FIBC according to the present invention, side edges of said sidewalls are shown as tacked but unstitched state, FIGS. 4*a*-4*d* show perspective and side views of an FIBC whose two opposing side walls are manufactured according to the present invention, FIGS. 5*a*-5*d* show perspective and side views of an FIBC whose four side walls are manufactured according to the present invention, FIG. 6 shows a two dimensional view of the sidewall of an FIBC according to the present invention where reference is made to lower, upper and side edges of a sidewall of an FIBC with respect to the vertical axis (y) and horizontal axis (x).

DETAILED DESCRIPTION OF THE INVENTION

The list of reference numerals used in the appended drawings is as follows;

1 FIBC
10 Envelope
11 Sidewall
12 Side edge
14 Upper edge
15 Lower edge
16 Filling spout
17 Discharge spout
18 Handle The stacking of known FIBCs one above the other is hampered by generally the convergent shape of the FIBC. If FIBCs have to be stacked in confined spaces such as shipping containers, the bulge in the middle and lower part and the constriction in the upper part of the FIBCs leads to stability problems. In order to solve the problems occurring in the prior art, the FIBC according to the present invention does not present the known rectangular shape when in the unfilled state. FIG. 1 and FIG. 2 shows a 2-dimensional view of the sidewall of an FIBC according to the present invention. As clearly seen, the sidewall of an FIBC is made by folding the two side edges of a perfectly rectangular envelope (10) which is shown by dashed lines on the right and left part of FIG. 2. As the FIBC is made of a flexible material, such as a polypropylene fabric, folding the two side edges of the envelope (10) made out of sheet material is easy. Folded portions of the envelope (10) are illustrated in dashed lines.

As clearly seen in FIG. 2, folding the two side edges of the envelope (10) is made uniformly along the vertical dimension of the sidewall (11) of the FIBC. The sidewall (11) of the FIBC according to the present invention is wider in the upper and lower portions of the FIBC as compared to the width in approximately the middle portion. The sidewall is formed of an upper portion UP formed of three portions UP1, UP2 and UP3. While the first upper portion UP1 has a rectangular geometry, the remaining upper portions UP2 and UP3 are in the shape of an isosceles trapezoid. The lower portion LP of the sidewall of the FIBC is formed of three portions LP1, LP2 and LP3. While the first lower portion LP1 has a rectangular geometry, the remaining lower portions LP2 and LP3 are in the shape of an isosceles trapezoid. The six portions forming the sidewall (11) of the FIBC are stacked such that a sidewall has narrowed width in its middle parts and full width in the first and last portions along the vertical direction.

As isosceles trapezoid is a closed geometry having a lower base and an upper base which are parallel to each other and which have different lengths. The two side edges have the same length and are symmetric to each other, implying that they make the same internal corner angles with both the upper base and the lower base.

FIGS. 3*a*, 3*b* and 3*c* show a plurality of sidewalls of an FIBC according to the present invention. The side edges of the sidewalls (11) are shown as in a tacked state. Once the two side edges are folded towards the inside of the sidewall (11), they are tacked in order to preserve the modified geometry of the sidewall until the time the tacked side edge is stitched to the side edge of a neighboring sidewall of the FIBC. The tacked parts of the sidewalls are shown by hatch lines in FIGS. 3*a*, 3*b* and 3*c*.

FIG. 4*a* to FIG. 4*d* show perspective and side views of an FIBC whose two opposing side walls are manufactured according to the present invention. This implies that two opposing sidewalls present a rectangular geometry while the remaining two opposing sidewalls have an upper portion UP and a lower portion LP which have varying width in the vertical direction (y) of the FIBC (1) as taught by the present invention. The vertical dimension of the FIBC is the direction starting from the lower edge (15) of a sidewall (11) towards the upper edge (14) of the same sidewall.

FIG. 5*a* to FIG. 5*d* show perspective and side views of an FIBC whose four side walls are manufactured according to the present invention. This implies that the all four sidewalls (11) of the FIBC (1) have a lower portion (LP1, LP2, LP3) and an upper portion (UP1, UP2, UP3). The FIBC (1) according to the present invention may have a filling spout (16) and a discharge spout (17) as shown in FIG. 5*b*.

FIG. 6 shows the markings made on an envelope (10) made of sheet material. Vertical direction (y) of an FIBC is defined as the direction starting from the lower edge (15) of a sidewall (11) towards the upper edge (14). As the lower edge (15) of a sidewall is parallel to the upper edge (14) of the same sidewall, the vertical direction (y) is perpendicular to both of the upper and lower edges (14,15). The horizontal direction of the FIBC is the x-direction as shown in FIG. 6.

The method of manufacturing a sidewall (11) of an FIBC (1) according to the present invention starts with the step of method of manufacturing an FIBC, comprising the steps of cutting flexible sheet material in the form of a rectangular envelope for forming a sidewall of the FIBC. As shown in FIG. 6, the envelope is marked such that the envelope has an upper portion (UP1, UP2, UP3) and a lower portion (LP1, LP2, LP3). The method further comprises the steps of;

Folding the right and left side edges of the upper portion UP such that the upper portion has a first upper portion (UP1) in the form of a rectangle having a predetermined height (a), a second upper portion (UP2) in the form of an isosceles trapezoid whose upper base is wider than its lower base and whose side edge is inclined with an angle of $\alpha 1$ with respect to the vertical axis (y), a third upper portion (UP3) in the form of an isosceles trapezoid whose upper base is wider than its lower base and whose side edge is inclined with an angle of $\beta 1$ with respect to the vertical axis (y), Folding the right and left side edges of the lower portion (LP) such that lower portion has a first lower portion (LP1) in the form of a rectangle having a predetermined height (f), a second lower portion (LP2) in the form of an isosceles trapezoid whose lower base is wider than its upper base and whose side edge is inclined with an angle of $\alpha 2$ with respect to the vertical axis (y)

a third lower portion (LP3) is in the form of an isosceles trapezoid whose lower base is wider than its upper base and whose side edge is inclined with an angle of $\beta 2$ with respect to the vertical axis (y), as illustrated in FIG. 6.

Once a sidewall (11) is obtained by the folding steps outlines above, the folded side edges of the lower portion (LP1, LP2, LP3) and the upper portion (UP1, UP2, UP3) are tacked. Thereafter, side edges of four sidewalls are stitched to each other such that all sidewalls of a cubical FIBC are formed.

According to the present invention, at least two opposing sidewalls shall be manufactured as outlined by the folding steps taught above. In such a case, the remaining two sidewalls may be in the form of the known rectangular sidewalls. Should any bulging occurs in the sidewalls having the known rectangular geometry, the FIBC may be rotated 90 degrees to so that it may fit into a limited width of a confined box, such as a shipment container. Alternatively, all four sidewalls may be manufactured as taught by the folding steps above. The remaining method steps include stitching a bottom wall to the bottom edges of the four sidewalls and stitching a plurality of handles to the sidewalls of the FIBC.

Referring now back FIG. 6, the applicant has found that the total height of the upper portion (UP1, UP2, UP3) shall not be same with the total height of the lower portion (LP1, LP2, LP3). The reason is simply the fact that the pressure on the lower portion LP is higher than the pressure in the upper portion UP. Furthermore, the applicant further found out that the angles ($\alpha 1$, $\beta 1$) made by the side edges of the trapezoids (UP2, UP3) of the upper portion shall not be the same with the angles ($\alpha 2$, $\beta 2$) made by the side edges of the trapezoids (LP2, LP3) of the lower portion. In order to obtain the best result, which implies most reduced bulging of a sidewall, the concerned angles, as illustrated in FIG. 6, shall be in the range of;

$7° \leq \alpha 1 \leq 15°$ $9° \leq \alpha 2 \leq 16°$ $2° \leq \beta 1 \leq 7°$ $2° \leq \beta 2 \leq 7°$ for any FIBC having a total height in between 1 m to 2 m, as most commonly used by the industry.

FIG. 6 further shows the amount of folding the side edges of the upper portion (UP1, UP2, UP3). Said amount corresponds to the offset in the x-direction. For the first upper portion UP1, the offset amount is (g), which is the smallest among the offset amount (h) for the second upper portion (UP2) and the offset amount (i) for the third upper portion (UP3). The maximum amount of folded offset occurs at the joint of third upper portion (UP3) and the third lower portion (LP3), designated as (i) in FIG. 6. This maximum amount of folded offset, designated as (i) in FIG. 6, shall be located in the range of 38% to 46% of the total height of the sidewall (11). Assuming a sidewall having a total height of 1 m in y-direction, the maximum amount of folded offset (i) shall be somewhere in between 38 cm to 46 cm height measured from the lower edge (15) of a sidewall (11).

The invention claimed is:

1. A method of manufacturing a Flexible Intermediate Bulk Container (FIBC), comprising the steps of;

a) cutting flexible sheet material in the form of a rectangular envelope for forming a sidewall of the FIBC;

b) marking the envelope such that the envelope has an upper portion and a lower portion;

c) folding right and left side edges of the upper portion such that the upper portion has a first upper portion in the form of a rectangle having a predetermined height, a second upper portion in the form of an isosceles trapezoid whose upper base is wider than its lower base and whose side edge is inclined with an angle of $\alpha 1$ with respect to the vertical axis, a third upper portion in the form of an isosceles trapezoid whose upper base is wider than its lower base and whose side edge is inclined with an angle of $\beta 1$ with respect to the vertical axis;

d) folding right and left side edges of the lower portion such that lower portion has a first lower portion in the form of a rectangle having a predetermined height, a second lower portion is in the form of an isosceles trapezoid whose lower base is wider than its upper base and whose side edge is inclined with an angle of $\alpha 2$ with respect to the vertical axis, a third lower portion is in the form of an isosceles trapezoid whose lower base is wider than its upper base and whose side edge is inclined with an angle of $\beta 2$ with respect to the vertical axis;

e) tacking the folded right and left side edges of the lower portion and the upper portion;

f) stacking three upper portions and three lower portions to form the sidewall of the FIBC, wherein the sidewall has narrowed width in its middle parts and full width in first and last portions along the vertical direction;

g) stitching side edges of four sidewalls to each other such that all sidewalls of the FIBC are formed;

h) stitching a bottom wall to the lower edges of the four sidewalls; and i) stitching a plurality of handles to the sidewalls of the FIBC.

2. The method of manufacturing an FIBC as set forth in claim 1 wherein the angles made by the side edges of the trapezoids are in the following ranges:

$7° \leq \alpha 1 \leq 15°$ $9° \leq \alpha 2 \leq 16°$ $2° \leq \beta 1 \leq 7°$ $2° \leq \beta 2 \leq 7°$.

3. The method of manufacturing an FIBC as set forth in claim 1 wherein the maximum amount of offset folded at a junction of third upper portion and the third lower portion is made at a vertical position ranging from 38% to 46% of a total height of the sidewall, measured from the lower edge of the sidewall.

4. A FIBC obtained by the manufacturing method of claim 1.

* * * * *